US010272540B2

(12) United States Patent
Lai et al.

(10) Patent No.: US 10,272,540 B2
(45) **Date of Patent: *Apr. 30, 2019**

(54) SYSTEM AND METHOD FOR POLISHING SUBSTRATE

(71) Applicant: Taiwan Semiconductor Manufacturing Co., Ltd, Hsinchu (TW)

(72) Inventors: Jiun-Yu Lai, Taipei (TW); Ying-Hsiu Tsai, Hsinchu (TW); Wei-Chen Chang, Nantou (TW); Yi-Ching Chiou, Hsinchu (TW)

(73) Assignee: TAIWAN SEMICONDUCTOR MANUFACTURING CO., LTD, Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/596,160

(22) Filed: May 16, 2017

(65) Prior Publication Data

US 2017/0246723 A1 Aug. 31, 2017

Related U.S. Application Data

(63) Continuation of application No. 14/725,367, filed on May 29, 2015, now Pat. No. 9,669,514.

(51) Int. Cl.

| | |
|---|---|
| ***B24B 49/10*** | (2006.01) |
| ***B24B 37/005*** | (2012.01) |
| ***B24B 37/04*** | (2012.01) |
| ***B24B 53/017*** | (2012.01) |

(52) U.S. Cl.

CPC ..... *B24B 49/105* (2013.01); *B24B 37/005* (2013.01); *B24B 37/042* (2013.01); *B24B 53/017* (2013.01)

(58) Field of Classification Search

None

See application file for complete search history.

(56) References Cited

U.S. PATENT DOCUMENTS

| | | | | |
|---|---|---|---|---|
| 6,045,434 | A | 4/2000 | Fisher | |
| 6,966,816 | B2 * | 11/2005 | Swedek | B24B 37/013 324/230 |
| 7,195,536 | B2 * | 3/2007 | Swedek | B24B 37/013 451/288 |

(Continued)

FOREIGN PATENT DOCUMENTS

| | | |
|---|---|---|
| TW | 201438845 | 10/2014 |

OTHER PUBLICATIONS

Chinese language office action dated Sep. 5, 2016, issued in application No. TW 104139089.

*Primary Examiner* — Allan W. Olsen

(74) *Attorney, Agent, or Firm* — McClure, Qualey & Rodack, LLP

(57) ABSTRACT

Polishing systems and methods for polishing a substrate are provided. The method includes polishing a substrate using a polishing pad and monitoring a thickness of the polishing pad. The monitoring of the thickness of the polishing pad is performed by detecting an eddy current generated from a conductor element below a bottom surface of the polishing pad. The method also includes replacing the polishing pad with a second polishing pad if the thickness of the polishing pad is smaller than a predetermined value.

20 Claims, 8 Drawing Sheets

(56) References Cited

U.S. PATENT DOCUMENTS 7,682,221 B2 * 3/2010 Swedek ..... B24B 37/013 324/230
7,840,305 B2 * 11/2010 Behr ..... B24B 49/02 438/5
7,846,008 B2 * 12/2010 Bajaj ..... B24B 37/26 451/527
8,043,870 B2 * 10/2011 Manens ..... B24B 37/042 257/E21.528
8,066,555 B2 * 11/2011 Bajaj ..... B24B 37/26 451/527
8,075,745 B2 * 12/2011 Bajaj ..... B23H 5/08 204/224 M
8,221,191 B2 * 7/2012 Matsuzaki ..... B24B 37/013 451/21
8,296,961 B2 * 10/2012 Nakayoshi ..... B24B 37/042 33/501.02
8,870,625 B2 10/2014 Togawa et al.
2001/0010999 A1 8/2001 Numoto
2002/0164925 A1 11/2002 Swedek
2003/0123067 A1 7/2003 Chuang
2004/0124087 A1 * 7/2004 Christ ..... C04B 35/565 205/83
2004/0192168 A1 9/2004 Faustman
2005/0287929 A1 * 12/2005 Swedek ..... B24B 37/013 451/5
2006/0196283 A1 9/2006 Yang
2007/0015442 A1 1/2007 Shin
2007/0135958 A1 * 6/2007 Swedek ..... B24B 37/013 700/121
2008/0004743 A1 1/2008 Goers
2008/0164153 A1 7/2008 Bajaj
2008/0248734 A1 10/2008 Bajaj
2009/0023361 A1 1/2009 Matsuzaki
2009/0036024 A1 2/2009 Matsuzaki
2009/0137190 A1 5/2009 Togawa
2009/0280580 A1 * 11/2009 Manens ..... B24B 37/042 438/7
2010/0197197 A1 8/2010 Nakayoshi
2010/0203815 A1 8/2010 Bajaj
2011/0006761 A1 * 1/2011 Redko ..... G01N 27/904 324/239
2011/0256812 A1 10/2011 Dhandapani
2012/0270477 A1 * 10/2012 Nangoy ..... B24B 37/042 451/56
2013/0337722 A1 12/2013 Namiki
2014/0148008 A1 5/2014 Wu et al.
2015/0099424 A1 4/2015 Takahashi
2018/0056476 A1 * 3/2018 Zhang ..... B24B 37/005

* cited by examiner

SYSTEM AND METHOD FOR POLISHING SUBSTRATE

CROSS REFERENCE

This application is a Continuation application of U.S. patent application Ser. No. 14/725,367, filed on May 29, 2015, now U.S. Pat. No. 9,669,514, the entire of which is incorporated by reference herein.

BACKGROUND

The semiconductor integrated circuit (IC) industry has experienced rapid growth. Technological advances in IC materials and design have produced generations of ICs. Each generation has smaller and more complex circuits than the previous generation. However, these advances have increased the complexity of processing and manufacturing ICs. In the course of IC evolution, functional density (i.e., the number of interconnected devices per chip area) has generally increased while geometric size (i.e., the smallest component (or line) that can be created using a fabrication process) has decreased. This scaling-down process generally provides benefits by increasing production efficiency and lowering associated costs.

In recent decades, the chemical mechanical polishing (CMP) process has been used to planarize layers used to build up ICs, thereby helping to provide more precisely structured device features of the ICs. The CMP process is a planarization process that combines chemical removal with mechanical polishing. The CMP process is a favored process because it achieves global planarization across the entire wafer surface. The CMP polishes and removes materials from the wafer, and works on multi-material surfaces.

Since the CMP process is one of the important processes for forming ICs, it is desired to have mechanisms to maintain the reliability and the efficiency of the CMP process.

BRIEF DESCRIPTION OF THE DRAWINGS

Aspects of the present disclosure are best understood from the following detailed description when read with the accompanying figures. It should be noted that, in accordance with the standard practice in the industry, various features are not drawn to scale. In fact, the dimensions of the various features may be arbitrarily increased or reduced for clarity of discussion.

DETAILED DESCRIPTION

Figure 1:
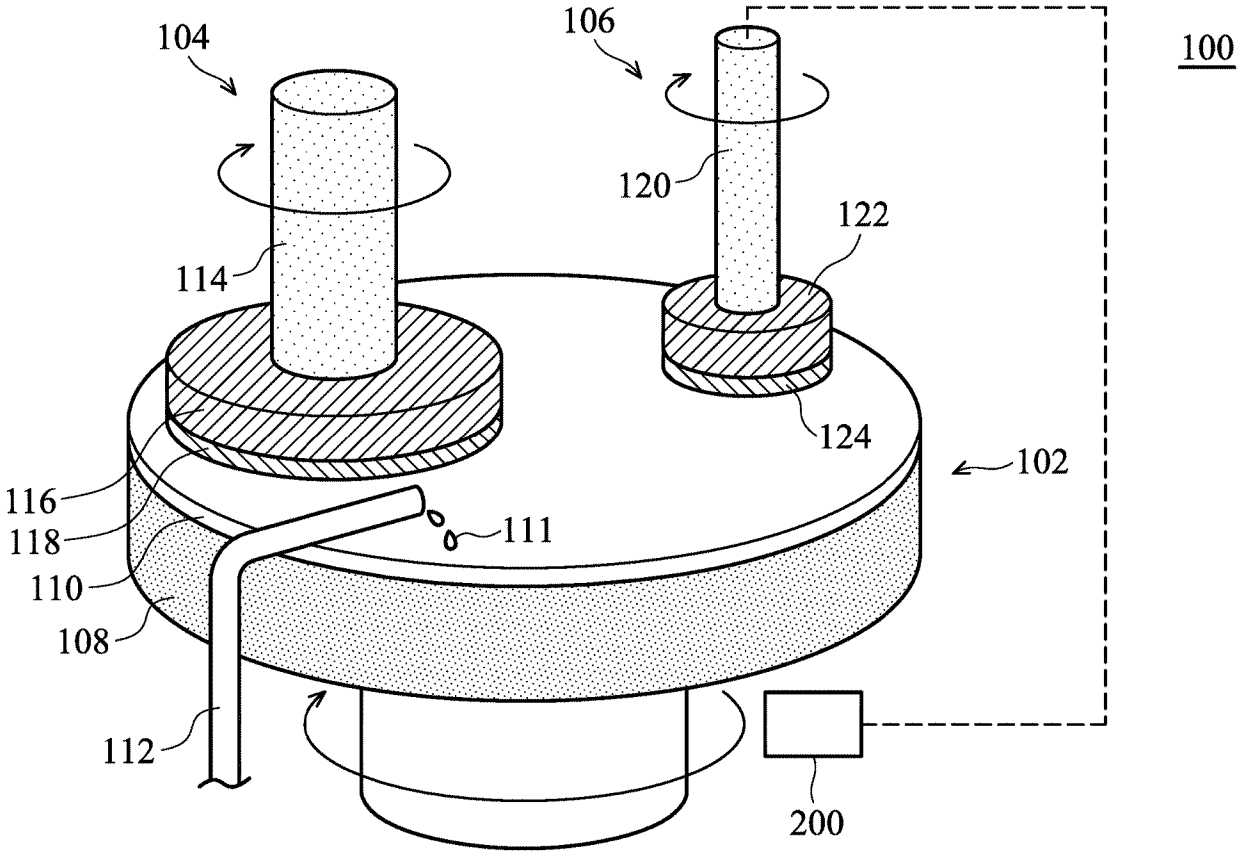
FIG. 1 is a perspective view of a polishing system, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Some embodiments of the disclosure are described. FIG. 1 is a perspective view of a polishing system 100, in accordance with some embodiments. Additional features can be added in the polishing system. Some of the features described below can be replaced or eliminated for different embodiments. In some embodiments, the polishing system 100 is a chemical mechanical polishing (CMP) system. The CMP system uses a combination of chemical reactions and mechanical grinding to remove material from a surface of a semiconductor device.

As shown in FIG. 1, the polishing system 100 includes a polishing assembly 102 and a substrate carrying assembly 104, in accordance with some embodiments. The substrate carrying assembly 104 is configured to hold a substrate 118 against the polishing assembly 102 to perform a polishing process, such as a CMP process. In some embodiments, the substrate 118 is a semiconductor wafer. In some embodiments, the substrate carrying assembly 104 includes a robot arm 114 and a substrate carrier 116. The substrate carrier 116 may also be called a polishing head. In some embodiments, the robot arm 114 includes a rotatable shaft.

The polishing assembly 102 is configured to polish the surface of the substrate 118. In some embodiments, the polishing assembly 102 includes a platen 108 and a polishing pad 110 that is mounted or fixed over the platen 108. In some embodiments, the platen 108 is a rotatable platen that is configured to rotate in one or more directions. The platen 108 may be able to rotate in a clockwise direction and/or a counterclockwise direction. In some embodiments, the polishing assembly 102 further includes a slurry delivery unit 112. The slurry delivery unit 112 is used to supply a slurry 111 onto the polishing pad 110.

The slurry 111 may include slurry particles of special sizes, and shapes, and be suspended in an aqueous solution. The slurry particles may be roughly as hard as the material layer of the substrate 118 that is to be polished. Acids or bases may be added to the aqueous solution, depending on the material to be polished. Other additives may be added to the aqueous solution, such as surfactants and/or buffer agents.

The substrate carrier 116 is adapted to hold the substrate 118 to engage a surface of substrate 118 with the polishing pad 110. The substrate carrier 116 may also be adapted to provide downward pressure on the substrate 118. In some embodiments, when the polishing process (such as the CMP process) is being performed, the polishing pad 110 is in direct contact with the substrate 118 and is spun by the platen 108. In some embodiments, the slurry 111 is continuously provided on the polishing pad 110 by the slurry delivery unit 112 during the polishing process.

In some embodiments, the substrate 118 is also rotated by the substrate carrying assembly 104 during the polishing process. In some embodiments, the substrate 118 and the polishing pad 110 are simultaneously rotated in the same direction. For example, both the substrate 118 and the polishing pad 110 are rotated in a clockwise direction. Alternatively, both the substrate 118 and the polishing pad 110 are rotated in a counterclockwise direction. In some embodiments, the substrate 118 and the polishing pad 110 are simultaneously rotated in different directions (i.e., one in a clockwise direction and another one in a counterclockwise direction). In some other embodiments, the substrate 118 is not rotated during the polishing process.

The polishing rate may be affected by various parameters. The parameters may include the downward pressure on the substrate 118, the rotational speeds of the platen 108 and the substrate carrier 116, the chemical composition of the slurry 111, the concentration of the slurry particles in the slurry 111, the temperature of the slurry 111, and the shape, size, and/or distribution of the slurry particles in the slurry 111.

Figure 2A:
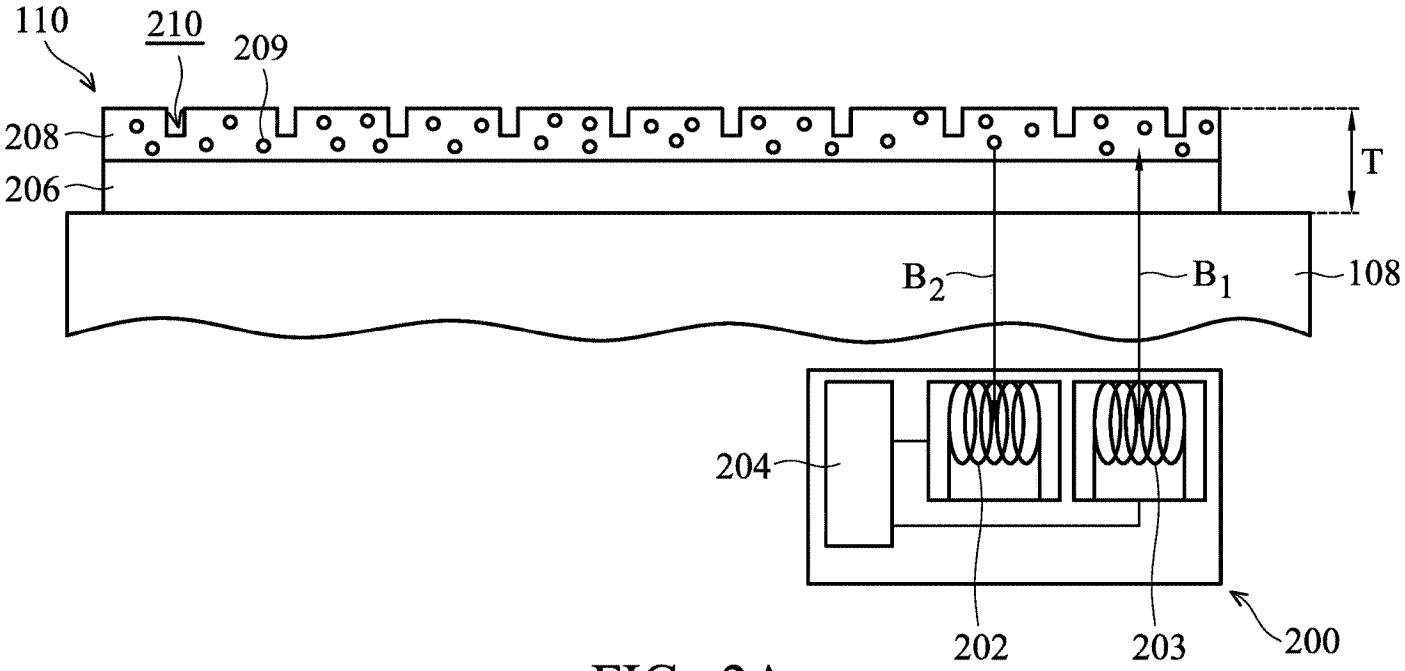
FIG. 2A is a cross-sectional view of a portion of a polishing system, in accordance with some embodiments.

In some embodiments, the polishing pad 110 is a porous structure, and has a rough polishing surface. In some embodiments, the polishing pad 110 includes multiple recesses. The recesses may be used to hold the slurry 111 to ensure a sufficient amount of slurry 111 is provided between the polishing pad 110 and the substrate 118 during the polishing process. FIG. 2A is a cross-sectional view of a portion of a polishing system (such as the polishing system 100), in accordance with some embodiments. In some embodiments, the polishing pad 110 includes multiple recesses 210, as shown in FIG. 2A. In some embodiments, the recesses 210 are trenches.

After the polishing process is performed, polishing debris (coming from, for example, the removed portion of the substrate and/or the slurry particles) may fill the pores of the polishing pad 110. Therefore, the polishing surface becomes smooth, and the surface roughness of the polishing pad 110 is decreased. As a result, the polishing rate is decreased.

In order to maintain the polishing rate, the polishing pad 110 is conditioned to restore the texture of the polishing pad 110, in accordance with some embodiments. A dressing operation (or a conditioning operation) is performed to the polishing pad 110. In some embodiments, the polishing system 100 further includes a conditioning assembly 106, as shown in FIG. 1. The conditioning assembly 106 includes a robot arm 120, a dresser head 122, and a conditioning disc 124, in accordance with some embodiments. In some embodiments, the robot arm 120 includes a rotatable shaft. In some embodiments, the slurry delivery unit 112, the substrate carrying assembly 104, and conditioning assembly 106 are sequentially arranged along a spinning direction of the platen 108, as shown in FIG. 1. In some embodiments, the conditioning of the polishing pad 110 is performed during the polishing of the substrate 118.

In some embodiments, the conditioning disc 124 is a diamond disc. The diamond disc includes diamonds that are embedded in a metallic layer. The metallic layer is secured to a support plate of the conditioning disc 124. The metallic layer is, for example, a Ni layer and/or a Cr layer. The conditioning disc 124 is used to scratch and remove a surface portion of the polishing pad 110 that has accumulated too much polishing debris after the polishing process. A lower portion of the polishing pad 110, which is fresh, is thus exposed and used to continue the polishing process. Due to the dressing by the conditioning disc 124, the surface of the polishing pad 110 is refreshed. Since the texture of the polishing pad 110 is restored, the polishing rate is maintained.

As mentioned above, the polishing pad 110 is conditioned by the conditioning assembly 106 to restore the texture of the polishing pad 110. The polishing pad 110 is therefore consumed after the conditioning operation. As the thickness of the polishing pad 110 is reduced, the depths of the recesses 210 are also reduced. As a result, when the polishing pad 110 is consumed too much, the polishing pad 110 may not be able to hold a sufficient amount of the slurry 111. The polishing process may be negatively affected.

As shown in FIG. 1, the polishing system 100 further includes a thickness sensing assembly 200, in accordance with some embodiments. The thickness sensing assembly 200 is configured to monitor a thickness of the polishing pad 110. In some embodiments, the thickness of the polishing pad 110 is detected and monitored by the thickness sensing assembly 200. In some embodiments, the polishing pad 110 is replaced with a second polishing pad (such as a new polishing pad) before the thickness of the polishing pad 110 and/or the depths of the recesses 210 become too small. Therefore, the polishing pad 110 can be replaced with a new one in time, and the quality of the polishing process is maintained.

In some embodiments, the thickness sensing assembly 200 includes an eddy current sensing assembly. In some embodiments, the eddy current sensing assembly is configured to detect an eddy current generated from a conductor element which is positioned in or under the polishing pad 110. In some embodiments, the conductor element includes conductive fibers, conductive particles, one or more conductive layers, another suitable conductive element, or a combination thereof.

As shown in FIG. 2A, conductor elements 209 are dispersed in the polishing pad 110, in accordance with some embodiments. In some embodiments, the polishing pad 110 includes a top pad 208 and a bottom pad 206. In some embodiments, the conductor elements 209 are dispersed in the top pad 208. In some embodiments, the conductor elements 209 are dispersed evenly in the top pad 208. In some other embodiments, the conductor elements 209 are dispersed in the bottom pad 206. In some embodiments, the conductor elements are dispersed evenly in the bottom pad 206. In some other embodiments, the conductor elements 209 are dispersed in the top pad 208 and the bottom pad 206. The conductor elements 209 may include metal fibers, carbon fibers, metal particles, carbon particles, another suitable material, or a combination thereof.

In some embodiments, the thickness sensing assembly 200 is positioned below the platen 108, as shown in FIG. 2A or FIG. 1. In some embodiments, the thickness sensing assembly 200 includes a first coil 202 and a second coil 203. The second coil 203 may be used to generate a magnetic field $B_1$. The conductor elements 209 in the polishing pad 110 may generate an eddy current in response to the magnetic field $B_1$. The generated eddy current in turn creates a new magnetic field $B_2$. The first coil 202 may be used to sense the magnetic field $B_2$. The magnetic field $B_2$ is in proportion to the eddy current generated from the conductor elements 209. As the polishing pad 110 becomes thinner, the quantity of conductor elements 209 is also being reduced, which leads to a smaller eddy current and smaller magnetic field $B_2$. The sensed information can be used to calculate the thickness T of the polishing pad 110. Therefore, by detecting the magnetic field $B_2$, the thickness T of the polishing pad 110 is detected and monitored.

Figure 3:
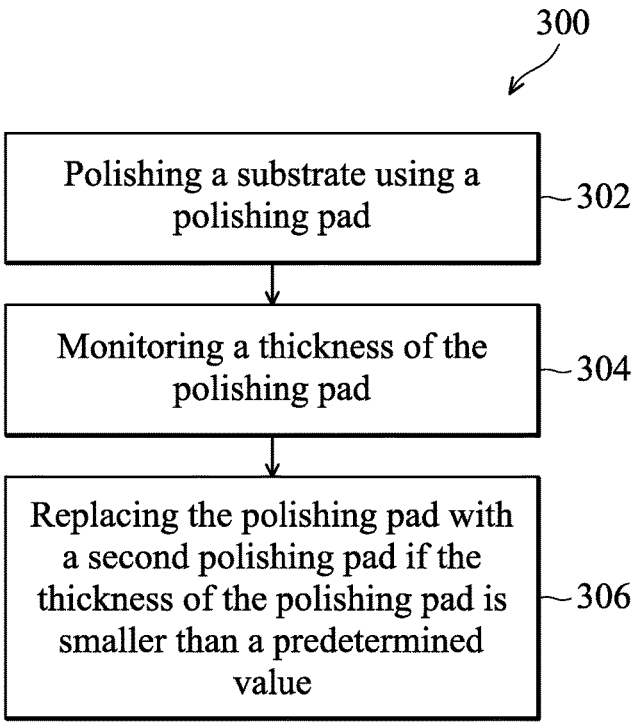
FIG. 3 is a flow chart illustrating a method for performing a polishing process, in accordance with some embodiments.

FIG. 3 is a flow chart illustrating a method 300 for performing a polishing process, in accordance with some embodiments. Referring to FIGS. 1, 2A, and 3, the method 300 begins with an operation 302 in which the substrate 118 is polished using the polishing pad 110. The method 300 continues with an operation 304 in which the thickness T of the polishing pad 110 is monitored. In some embodiments, the thickness T is detected and monitored by the thickness sensing assembly 200. In some embodiments, the monitoring of the thickness T of the polishing pad 110 is performed while the substrate 118 is being polished by the polishing pad 110. In some other embodiments, the monitoring of the thickness T is performed before the substrate 118 is polished. In some other embodiments, the monitoring of the thickness T is performed after the substrate 118 is polished.

In some embodiments, the method 300 continues with an operation 306 in which the polishing pad 110 is replaced with a second polishing pad if the thickness T of the polishing pad 110 is smaller than a predetermined value, as shown in FIG. 3. The predetermined value may be set according to requirements. When the thickness T is greater than the predetermined value, the recesses 210 are deep enough to hold a sufficient amount of the slurry 111. The polishing process may be performed well, and it is not necessary to replace the polishing pad 110. When the thickness T is smaller than the predetermined value, the recesses 210 may not be able to hold a sufficient amount of the slurry 111. Therefore, if the thickness T is detected to be smaller than the predetermined value, the thickness sensing assembly 200 may indicate the situation. Therefore, the polishing pad 110 can be replaced with a second polishing pad (such as a new polishing pad) in time. The quality of the polishing process is maintained. The polishing pad 110 will not be replaced too early. Fabrication cost and fabrication time are therefore reduced.

In some embodiments, the thickness sensing assembly 200 includes a control unit 204. The control unit 204 may be used to send and/or receive electrical signals to and/or from the first coil 202 and the second coil 203. In some embodiments, the control unit 204 is electrically connected to or is capable of controlling an alarm unit (not shown). The alarm unit may be used to indicate that the polishing pad should be replaced with a new one. In some other embodiments, the control unit 204 is electrically connected to or capable of controlling a robot arm (not shown). Once the thickness T of the polishing pad 110 is smaller than the predetermined value, the robot arm starts to perform a polishing pad replacement operation.

As shown in FIG. 1, the thickness sensing assembly 200 is electrically connected to or capable of controlling the conditioning assembly 106, in accordance with some embodiments. In some embodiments, the control unit 204 of the thickness sensing assembly 200 is electrically connected to or capable of controlling the conditioning assembly 106. In some embodiments, the conditioning assembly 106 is controlled by the control unit 204.

Figure 4:
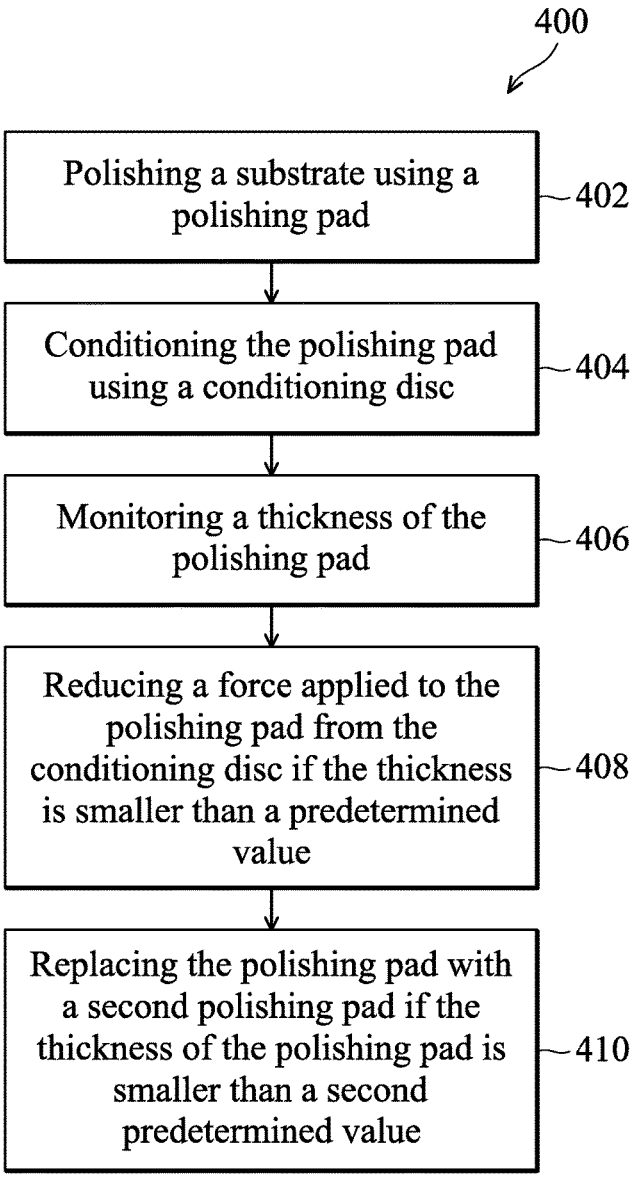
FIG. 4 is a flow chart illustrating a method for performing a polishing process, in accordance with some embodiments.

FIG. 4 is a flow chart illustrating a method 400 for performing a polishing process, in accordance with some embodiments. Referring to FIGS. 1, 2A, and 4, the method 400 begins with an operation 402 in which the substrate 118 is polished using the polishing pad 110. The method 400 continues with an operation 404 in which the polishing pad 110 is conditioned using the conditioning disc 124. In some embodiments, the conditioning of the polishing pad 110 and the polishing of the substrate 118 are performed simultaneously.

The method 400 continues with an operation 406 in which the thickness T of the polishing pad 110 is monitored. In some embodiments, the thickness T is detected and monitored by the thickness sensing assembly 200. In some embodiments, the monitoring of the thickness T of the polishing pad 110 is performed during the polishing of the substrate 118 and the conditioning of the polishing pad 110.

In some embodiments, the method 400 continues with an operation 408 in which a force applied to the polishing pad 110 from the conditioning disc 124 is reduced if the thickness T of the polishing pad 110 is smaller than a first predetermined value. Therefore, the consumption rate of the polishing pad 110 is reduced to increase the lifetime of the polishing pad 110. The method 400 continues with an operation 410 in which the polishing pad 110 is replaced with a second polishing pad if the thickness T of the polishing pad 110 is smaller than a second predetermined value, as shown in FIG. 4. In some embodiments, the second predetermined value mentioned in operation 410 is smaller than the first predetermined value mentioned in operation 408.

As mentioned above, the second predetermined value may be set according to requirements. When the thickness T is greater than the second predetermined value, the recesses 210 are deep enough to hold a sufficient amount of the slurry 111. The polishing process may be performed well, and it is not necessary to replace the polishing pad 110. When the thickness T is smaller than the second predetermined value, the recesses 210 may not be able to hold a sufficient amount of the slurry 111. Therefore, if the thickness T is detected to be smaller than the second predetermined value, the polishing pad 110 can be replaced with a second polishing pad (such as a new polishing pad) in time. The quality of the polishing process is maintained. The polishing pad 110 will not be replaced too early. Fabrication cost and fabrication time are therefore reduced.

Figure 5:
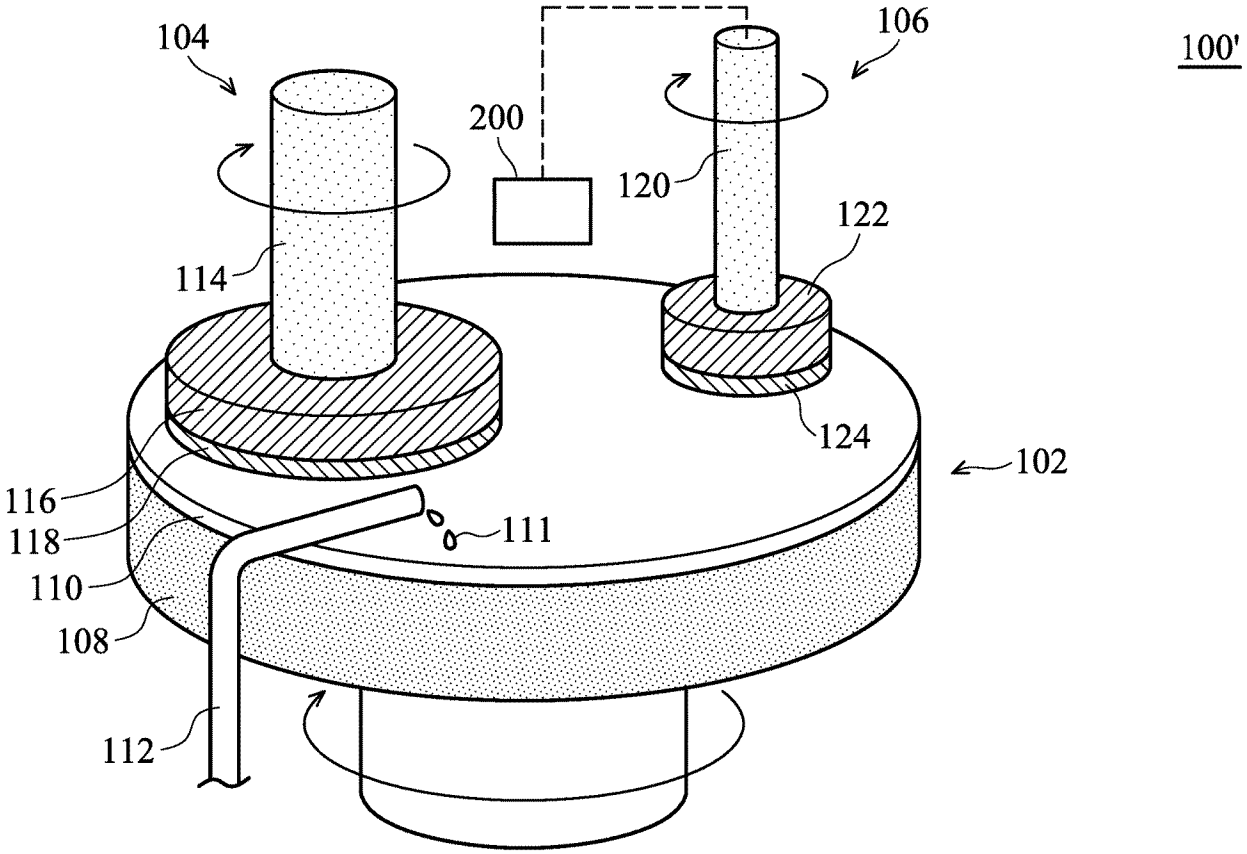
FIG. 5 is a perspective view of a polishing system, in accordance with some embodiments.
Figure 6:
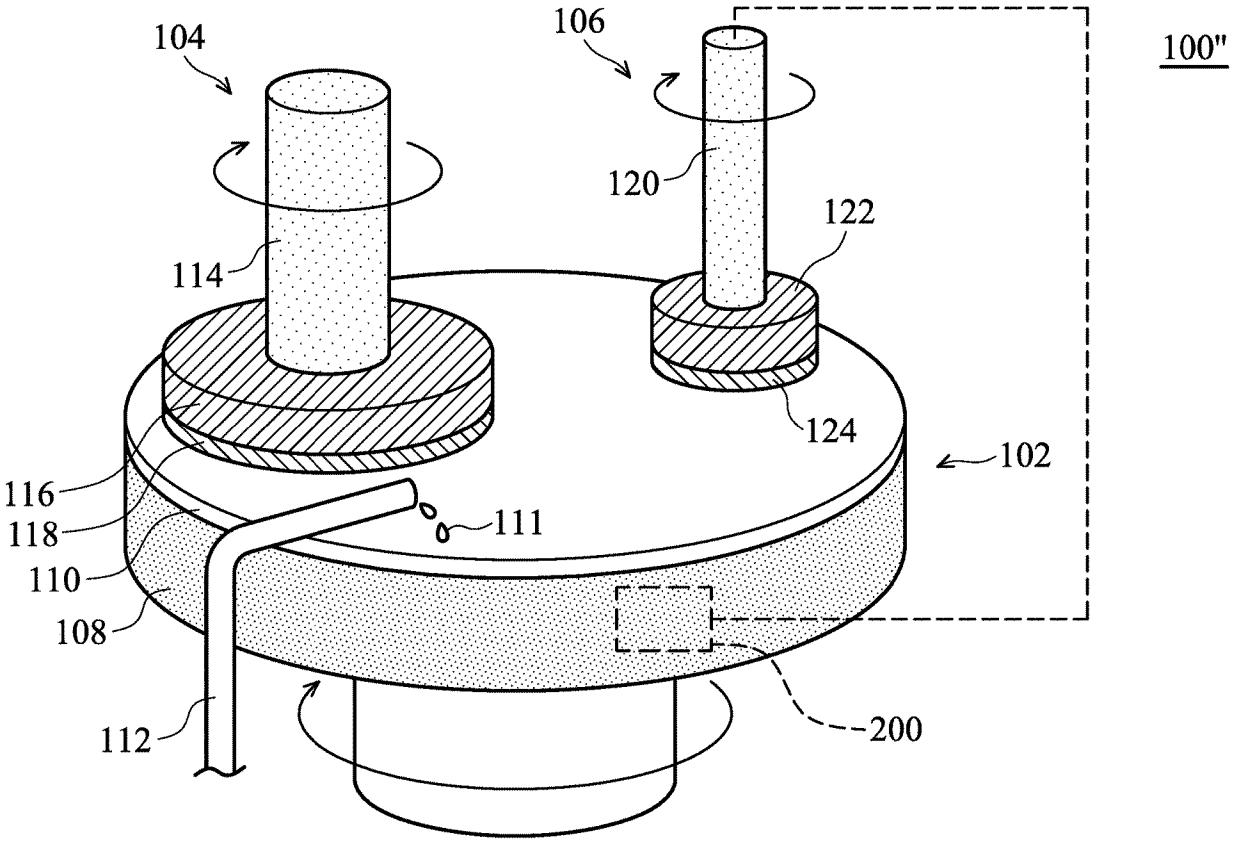
FIG. 6 is a perspective view of a polishing system, in accordance with some embodiments.

Many variations and/or modifications can be made to embodiments of the disclosure. FIG. 5 is a perspective view of a polishing system 100', in accordance with some embodiments. In some embodiments, the thickness sensing assembly 200 is positioned above the polishing pad 110, as shown in FIG. 5. FIG. 6 is a perspective view of a polishing system 100", in accordance with some embodiments. In some other embodiments, the thickness sensing assembly 200 is positioned in the platen 108, as shown in FIG. 6.

Figure 2B:
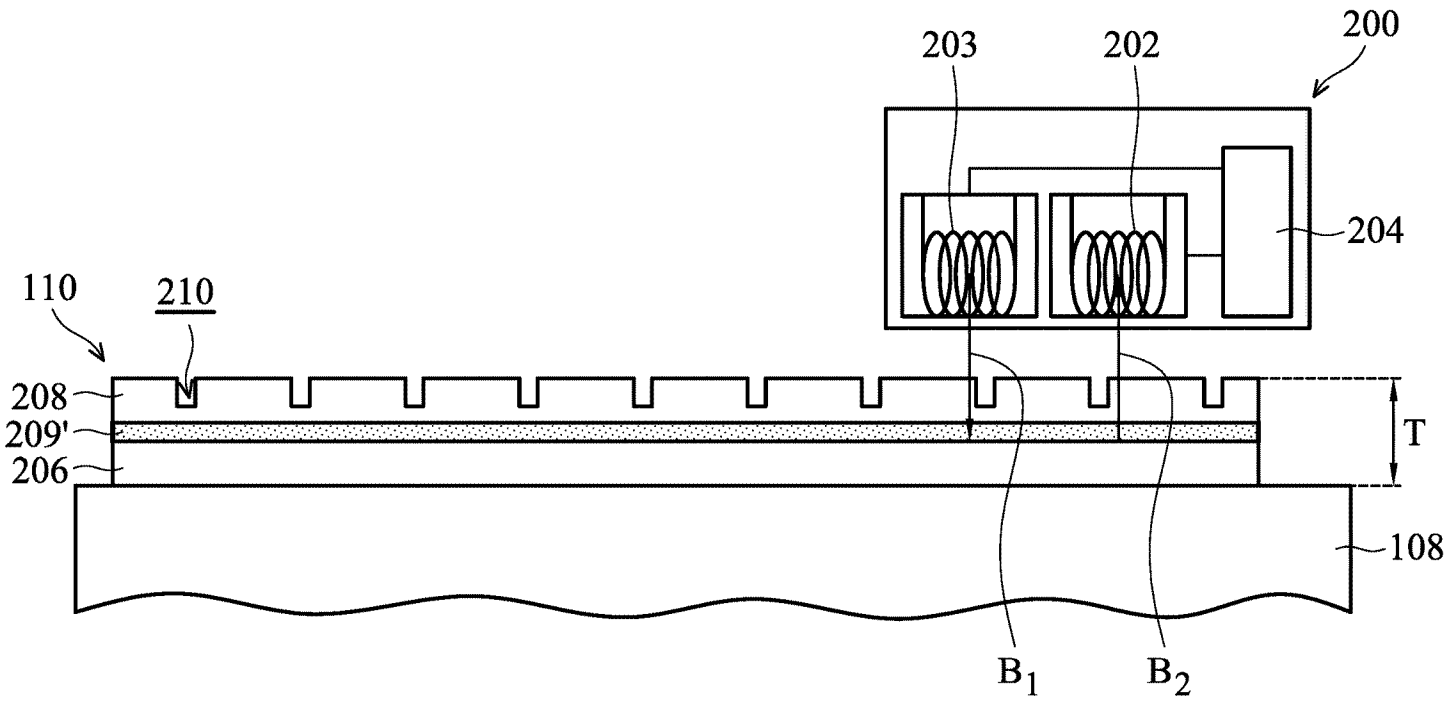
FIG. 2B is a cross-sectional view of a portion of a polishing system, in accordance with some embodiments.

Many variations and/or modifications can be made to embodiments of the disclosure. For example, the conductor element is not limited to being conductive fibers and/or conductive particles. In some embodiments, the conductor element includes a conductive layer. FIG. 2B is a cross-sectional view of a portion of a polishing system (such as the polishing system 100'), in accordance with some embodiments.

As shown in FIG. 2B, a conductive element 209' is formed in the polishing pad 110, in accordance with some embodiments. In some embodiments, the conductor element 209' is a conductive layer between the top pad 208 and the bottom pad 206 of the polishing pad 110. In some embodiments, the polishing pad 110 includes one or more conductive layers which are used as the conductor elements. In some embodiments, the conductive element 209' is one or more conductive layers which form a coil-like pattern. In some embodiments, the polishing system shown in FIG. 2B is used to perform the method 300 described in FIG. 3. In some embodiments, the polishing system shown in FIG. 2B is used to perform the method 300 described in FIG. 4.

As mentioned above, the second coil 203 may be used to generate a magnetic field $B_1$. The conductor element 209' in the polishing pad 110 generates an eddy current in response to the magnetic field $B_1$. The generated eddy current in turn creates a new magnetic field $B_2$. The first coil 202 may be used to sense the magnetic field $B_2$. The magnetic field $B_2$ is in proportion to the eddy current generated from the conductor elements 209'. The value of the magnetic field $B_2$ sensed by the first coil 202 is lower than the actual value due to the shielding of the polishing pad 110. As the polishing pad 110 becomes thinner after the consumption due to polishing and conditioning, the shielding of the polishing pad 110 from the magnetic field $B_2$ becomes weaker. Therefore, as the polishing pad 110 becomes thinner, the first coil 202 can sense a greater magnetic field $B_2$. Therefore, by detecting the magnetic field $B_2$, the thickness T of the polishing pad 110 is detected and monitored.

Figure 2C:
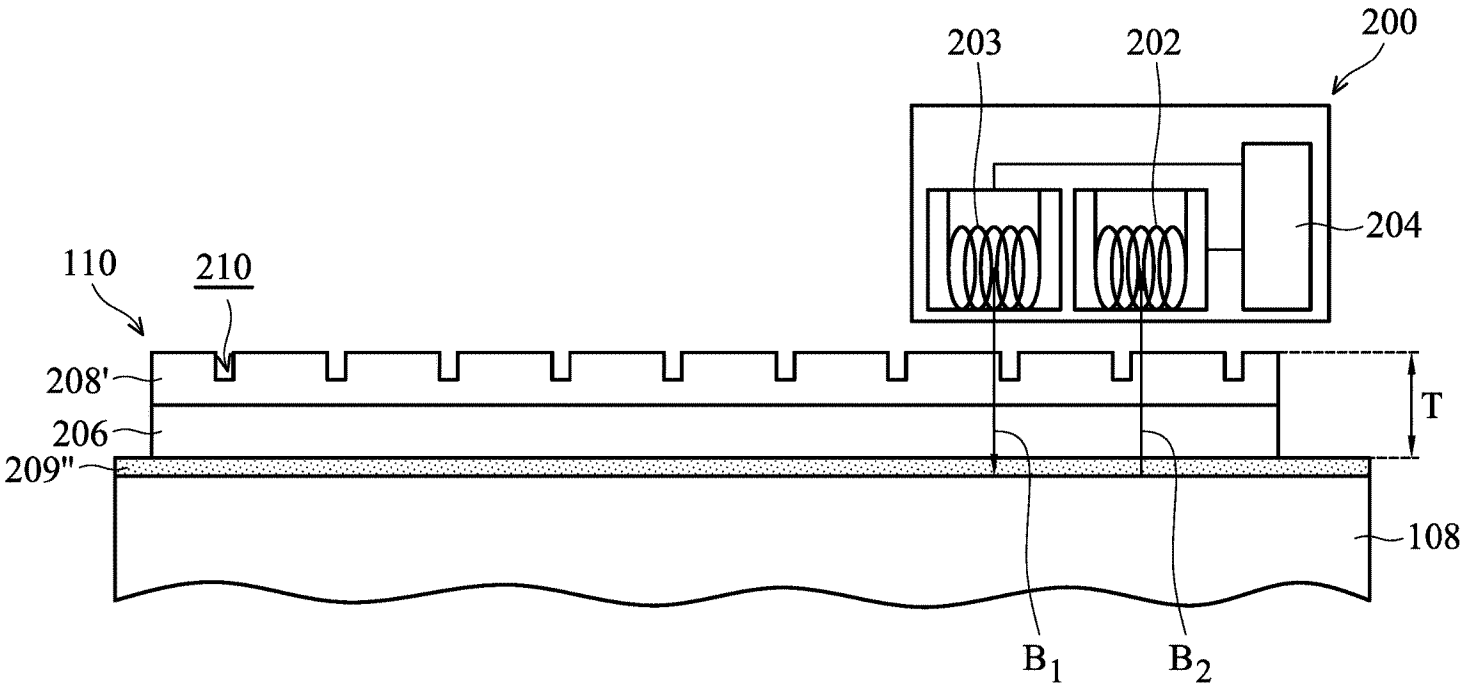
FIG. 2C is a cross-sectional view of a portion of a polishing system, in accordance with some embodiments.

Many variations and/or modifications can be made to embodiments of the disclosure. For example, the conductor element is not limited to being dispersed or formed in the polishing pad 110. In some embodiments, the conductor element is positioned outside of the polishing pad 110. In some embodiments, the conductor element is positioned under the polishing pad 110. FIG. 2C is a cross-sectional view of a portion of a polishing system, in accordance with some embodiments.

As shown in FIG. 2C, a conductor element 209" is formed under the polishing pad 110, in accordance with some embodiments. In some embodiments, the conductor element 209" is a conductive layer between the polishing pad 110 and the platen 108. In some other embodiments, the conductor element 209" includes multiple conductive layers. In some embodiments, the conductor element 209" is one or more conductive layers which form a coil-like pattern. In some embodiments, the polishing system shown in FIG. 2C is used to perform the method 300 described in FIG. 3. In some embodiments, the polishing system shown in FIG. 2C is used to perform the method 300 described in FIG. 4.

Similarly, the second coil 203 may be used to generate a magnetic field $B_1$ to induce the conductor element 209" under the polishing pad 110 to generate an eddy current. The generated eddy current in turn creates a new magnetic field $B_2$. The first coil 202 may be used to sense the magnetic field $B_2$. The magnetic field $B_2$ is in proportion to the eddy current generated from the conductor elements 209'. The value of the magnetic field $B_2$ sensed by the first coil 202 is lower than the actual value due to the shielding of the polishing pad 110. As the polishing pad 110 becomes thinner, the shielding of the polishing pad 110 from the magnetic field $B_2$ becomes weaker. Therefore, as the polishing pad 110 becomes thinner, the first coil 202 can sense a greater magnetic field $B_2$. Therefore, by detecting the magnetic field $B_2$, the thickness T of the polishing pad 110 is detected and monitored.

Embodiments of the disclosure provide a system and a method for polishing a substrate using a polishing pad. The polishing system includes a thickness sensing assembly. The thickness sensing assembly is configured to detect and monitor a thickness of the polishing pad. The thickness sensing assembly includes an eddy current sensing assembly. The eddy current sensing assembly is configured to detect an eddy current generated from a conductor element which is positioned in or under the polishing pad. The detected value is used to calculate the thickness of the polishing pad. Due to the assistance of the thickness sensing assembly, the polishing pad is replaced with a second polishing pad (such as a new polishing pad) before the thickness of the polishing pad gets too small. Therefore, the polishing pad can be replaced with a new one in time, and the quality of the polishing process is maintained.

In accordance with some embodiments, a polishing system is provided. The polishing system includes a polishing assembly having a platen and a polishing pad over the platen. The polishing system also includes a substrate carrying assembly configured to engage a substrate to the polishing pad. The polishing system further includes a thickness sensing assembly configured to monitor a thickness of the polishing pad.

In accordance with some embodiments, a method for performing a polishing process is provided. The method includes polishing a substrate using a polishing pad. The method also includes monitoring a thickness of the polishing pad. The method further includes replacing the polishing pad with a second polishing pad if the thickness of the polishing pad is smaller than a predetermined value.

In accordance with some embodiments, a method for performing a CMP process is provided. The method includes polishing a substrate using a polishing pad and providing a slurry between the substrate and the polishing pad. The method also includes conditioning the polishing pad and monitoring a thickness of the polishing pad. The method further includes replacing the polishing pad with a second polishing pad if the thickness of the polishing pad is smaller than a predetermined value.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method for performing a polishing process, comprising:

polishing a substrate using a polishing pad;

monitoring a thickness of the polishing pad, wherein the monitoring of the thickness of the polishing pad is performed by detecting an eddy current generated from a conductor element dispersed in the polishing pad, wherein the conductor element comprises conductive fibers, conductive particles, or a combination thereof; and replacing the polishing pad with a second polishing pad if the eddy current is smaller than a predetermined value.

2. The method for performing a polishing process as claimed in claim 1, wherein the monitoring of the thickness of the polishing pad is performed during the polishing of the substrate.

3. The method for performing a polishing process as claimed in claim 1, further comprising:

conditioning the polishing pad using a conditioning disc; and reducing a force applied to the polishing pad from the conditioning disc if the eddy current is smaller than a second predetermined value, wherein the second predetermined value is greater than the predetermined value.

4. The method for performing a polishing process as claimed in claim 1, wherein the eddy current is detected by a thickness sensing assembly, wherein at least a portion of the polishing pad is positioned between the thickness sensing assembly and the conductor element.

5. The method for performing a polishing process as claimed in claim 1, wherein the eddy current is detected by a thickness sensing assembly, wherein the thickness sensing assembly is positioned outside of the polishing pad.

6. The method for performing a polishing process as claimed in claim 1, wherein the eddy current is detected by a thickness sensing assembly, wherein the thickness sensing assembly is positioned below the polishing pad.

7. The method for performing a polishing process as claimed in claim 1, wherein the eddy current is detected by a thickness sensing assembly, wherein the thickness sensing assembly is positioned in a platen on which the polishing pad is placed.

8. The method for performing a polishing process as claimed in claim 1, wherein the conductor element comprises carbon particles, carbon fibers, or a combination thereof.

9. A method for performing a chemical mechanical polishing (CMP) process, comprising:

polishing a substrate using a polishing pad;

providing a slurry between the substrate and the polishing pad;

conditioning the polishing pad;

monitoring a thickness of the polishing pad, wherein the monitoring of the thickness of the polishing pad is performed by detecting an eddy current generated from a conductor element dispersed in an upper portion of the polishing pad, wherein the conductor element comprises carbon-containing conductive particles, carbon-containing conductive fibers, or a combination thereof; and replacing the polishing pad with a second polishing pad if the thickness of the polishing pad is smaller than a predetermined value.

10. The method for performing a CMP process as claimed in claim 9, wherein the monitoring of the thickness of the polishing pad is performed during the polishing of the substrate.

11. The method for performing a CMP process as claimed in claim 9, wherein the conditioning of the polishing pad is performed during the polishing of the substrate.

12. The method for performing a CMP process as claimed in claim 9, further comprising reducing a force applied to the polishing pad during the conditioning of the polishing pad if the thickness of the polishing pad is smaller than a second predetermined value, wherein the second predetermined value is greater than the predetermined value.

13. The method for performing a CMP process as claimed in claim 9, wherein the conductor element is dispersed evenly in the upper portion of the polishing pad.

14. A method for performing a polishing process, comprising:

polishing a substrate using a polishing pad;

monitoring a thickness of the polishing pad during the polishing of the substrate by detecting an eddy current generated from conductor elements positioned under a top surface of the polishing pad, wherein the conductor elements comprises carbon-containing conductive fibers, carbon-containing conductive fibers, or a combination thereof; and stopping the polishing of the substrate if the thickness of the polishing pad is smaller than a predetermined value.

15. The method for performing a polishing process as claimed in claim 14, further comprising replacing the polishing pad with a second polishing pad after the polishing of the substrate is stopped.

16. The method for performing a polishing process as claimed in claim 14, further comprising:

conditioning the polishing pad using a conditioning disc during the polishing of the substrate; and reducing a force applied to the polishing pad from the conditioning disc if the thickness of the polishing pad is smaller than a second predetermined value, wherein the second predetermined value is greater than the predetermined value.

17. The method for performing a polishing process as claimed in claim 14, wherein the polishing pad comprises a top pad and a bottom pad, and the conductor elements are positioned between a portion of the top pad and the bottom pad.

18. The method for performing a polishing process as claimed in claim 14, further comprising reducing a force applied to the polishing pad during a conditioning of the polishing pad if the thickness of the polishing pad is smaller than a second predetermined value, wherein the second predetermined value is greater than the predetermined value.

19. The method for performing a polishing process as claimed in claim 14, wherein the conductor elements are dispersed in the polishing pad.

20. The method for performing a polishing process as claimed in claim 19, wherein the conductor elements are dispersed evenly in an upper portion of the polishing pad.

* * * * *